United States Patent [19]

Pfeffer et al.

[11] Patent Number: 4,870,753

[45] Date of Patent: Oct. 3, 1989

[54] METHOD OF MANUFACTURING A LIGHT SOCKET

[75] Inventors: George B. Pfeffer, Minnetonka; Wayne A. Johnson, Minneapolis, Minn.

[73] Assignee: ADC Telecommunications, Inc, Minneapolis, Minn.

[21] Appl. No.: 125,555

[22] Filed: Nov. 25, 1987

Related U.S. Application Data

[62] Division of Ser. No. 764,948, Aug. 12, 1985, Pat. No. 4,753,609.

[51] Int. Cl.[4] ..... H01R 43/16

[52] U.S. Cl. ..... 29/884; 439/885

[58] Field of Search ..... 29/874, 884; 439/885, 439/541

[56] References Cited

U.S. PATENT DOCUMENTS

| | | | |
|---|---|---|---|
| 2,855,579 | 10/1958 | Wintriss | 29/884 X |
| 3,902,776 | 9/1975 | Williams et al. | 439/885 X |
| 3,905,665 | 9/1975 | Lynch et al. | 439/885 X |
| 4,188,715 | 2/1980 | Ammon et al. | 29/884 |
| 4,265,508 | 5/1981 | Chisholm | 439/885 |
| 4,712,299 | 12/1987 | Loewen et al. | 439/885 X |

*Primary Examiner*—Howard N. Goldberg
*Assistant Examiner*—Carl J. Arbes
*Attorney, Agent, or Firm*—Merchant, Gould, Smith, Edell, Welter & Schmidt

[57] ABSTRACT

The present invention is directed to a ganged lamp socket device especially applicable for a bank of LED's. The apparatus includes a housing having a row of sockets with a groove and first pockets on one side of the row and a plurality of second pockets on the other side. A common terminal strip fits in the groove and first pockets, while a plurality of contact members fit in the second pockets. The apparatus is easily assembled using the common strip and plurality of contact members formed in a single conductive sheet. The strip is inserted in the groove and broken from the sheet and then the contact members which are held together by a carrier are inserted in the second pockets. The carrier is broken from the contact members and all items are pressed into place. The apparatus reduces the number of piece parts normally needed for this type of device and increases system reliability.

2 Claims, 3 Drawing Sheets

FIG. 6
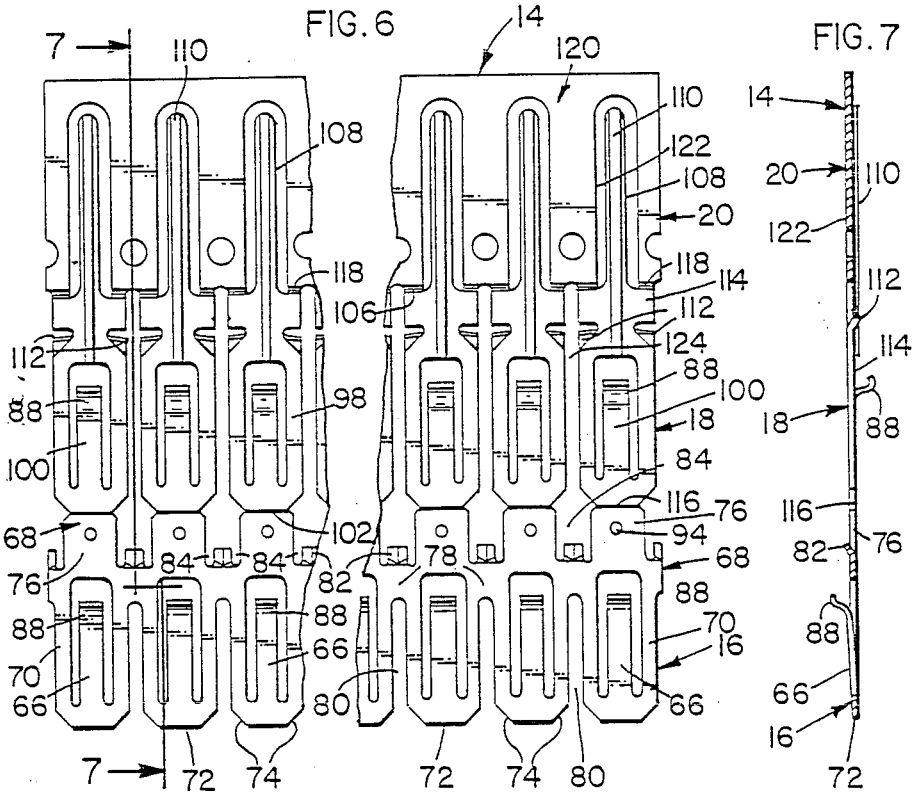
FIG. 7
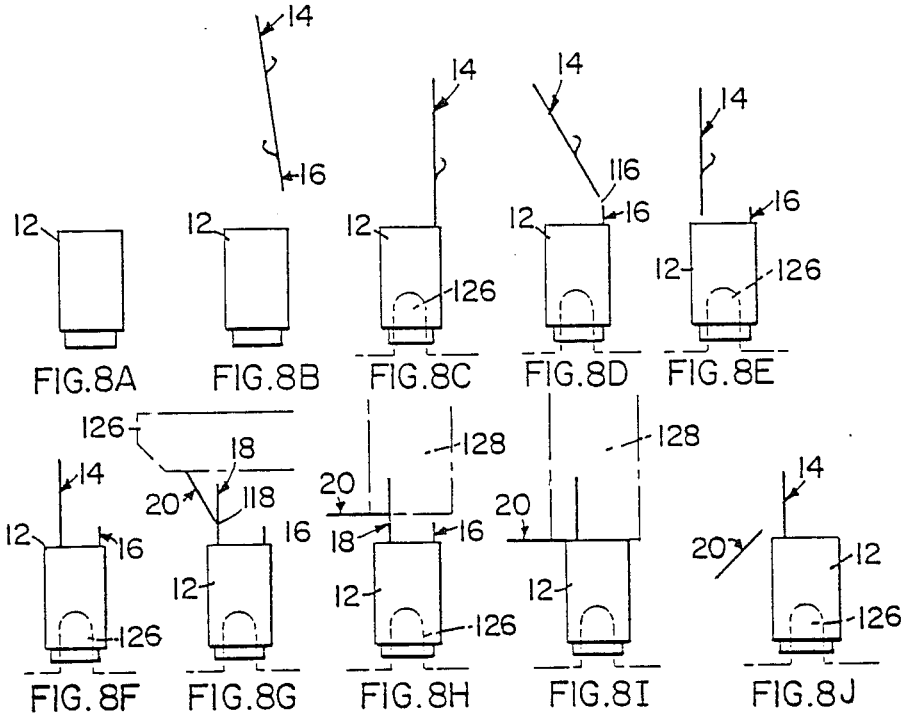
FIG.8A FIG.8B FIG.8C FIG.8D FIG.8E
FIG.8F FIG.8G FIG.8H FIG.8I FIG.8J

METHOD OF MANUFACTURING A LIGHT SOCKET

This is a division, of application Ser. No. 764,948, filed Aug. 12, 1985 now U.S. Pat. No. 4,753,609 issued 6/28/88.

FIELD OF THE INVENTION

The present invention is directed to a lamp socket device with particular application for receiving light emitting diode lamps.

BACKGROUND OF THE INVENTION

Light emitting diodes are commonly used as indicators of certain conditions with respect to particular electrical circuits. Frequently, a bank of LEDs are mounted in an equipment rack so that the group of condition indicators may be easily viewed. A common structure for such mounting includes a base member with a plurality of individual LED lamp socket assemblies screwed to the base. Typical lamp socket assemblies include a housing with contact members separated by an insulating member, all attached with rivets or other attaching mechanisms to the housing. Typical LED lamps for use with such sockets incude a housing with a lamp mounted thereto and connected through a circuit board to wire leads. The wire leads extend from the circuit board through the bottom of the housing so that when the lamp housing is inserted into the socket, the wire leads are located on opposite sides of the insulating barrier between the insulating barrier and the contact springs.

The indicated lamp receiving structure is a problem in that the wire leads or the connections of the wire leads to the circuit board or the connections of the circuit board to the LED are weaker and, hence, fail before it is possible to insert the leads as appropriate in the receiving socket between the contact springs and the insulating barrier. In addition, the indicated structure results in a large number of piece parts and a labor-intensive assembly. The present invention is directed to reducing the number of piece parts and assembly time, as well as reducing the failure rate of LED lamps during insertion of same in a socket structure.

SUMMARY OF THE INVENTION

The present invention is directed to apparatus for receiving lamps wherein each of the lamps has a sidewall with first and second electrical contact surfaces therealong. The apparatus includes an elongated, insulated housing having a row of aligned sockets. First and second electrically conductive contacting mechanisms are fastened to the housing on opposite sides of the row of sockets. The contacting mechanisms are in contact with the first and second surfaces of the lamps.

In a particular embodiment, the first contacting mechanism includes an integral strip for common connection to all the first contact surfaces of the lamps. The second contacting mechanism includes a plurality of separate members each of which independently contacts one of the second contact surfaces of the lamps.

The present invention is also directed to the method for manufacturing a lamp receiving apparatus from a lamp socket housing and a formed conductive sheet. The sheet includes a contact strip, a row of contact elements and a carrier. The housing includes a row of sockets for receiving the lamps with first mechanism on one side of the row for receiving the contact strip and second mechanism on the other side of the row for receiving the contact members. The method includes the steps of inserting the contact strip while a part of the sheet into the first receiving mechanism. The contact strip is broken from the sheet. Next the row of contact members now held by the carrier are inserted into the second receiving mechanism and broken from the carrier. Finally, the contact strip and the row of contact members are pressed into a final location with respect to the housing.

The present invention is particularly advantageous in that it comprises a reduced number of piece parts so that the manfuacturing method is particularly efficient and the resultant apparatus is more reliable and less costly. In addition, the housing includes grooves on opposite sides of each socket with the contact springs of the common strip and the contact springs of each of the separate elements extending into the grooves. In this way, the wire leads on the LED lamps may be bent around the bottom edge of the lamp housing and up the sidewall to provide strain relief for the leads. The leads make contact with the contact springs when the LED lamps are inserted in the sockets. Thus, not only is the lamp receiving apparatus more reliable, but it results in the strain relief lead design which reduces the failure rate of the LED lamps.

To better understand these advantages and other objects obtained by the invention, refer to the following drawings and the detailed description thereafter of a preferred embodiment.

BRIEF DESCRIPTION OF THE DRAWINGS

FIG. 6 is a top plan view of a formed sheet includes a terminal strip, a plurality of individual elements, and a carrier;

FIG. 7 is a cross-sectional view taken along line 7—7 of FIG. 6; and FIGS. 8A–8J illustrate in sequence the method of manufacturing the inventive apparatus.

DETAILED DESCRIPTION OF THE PREFERRED EMBODIMENT

Figure 1:
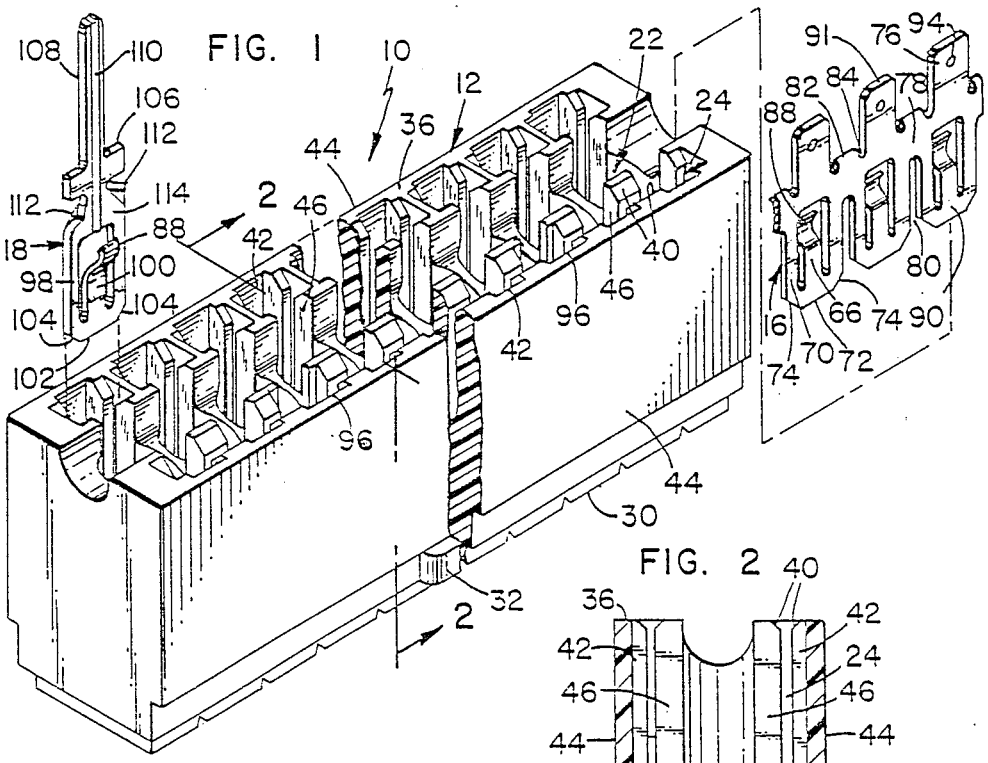
FIG. 1 shows an exploded, perspective view of apparatus in accordance with the present invention.
Figure 3:
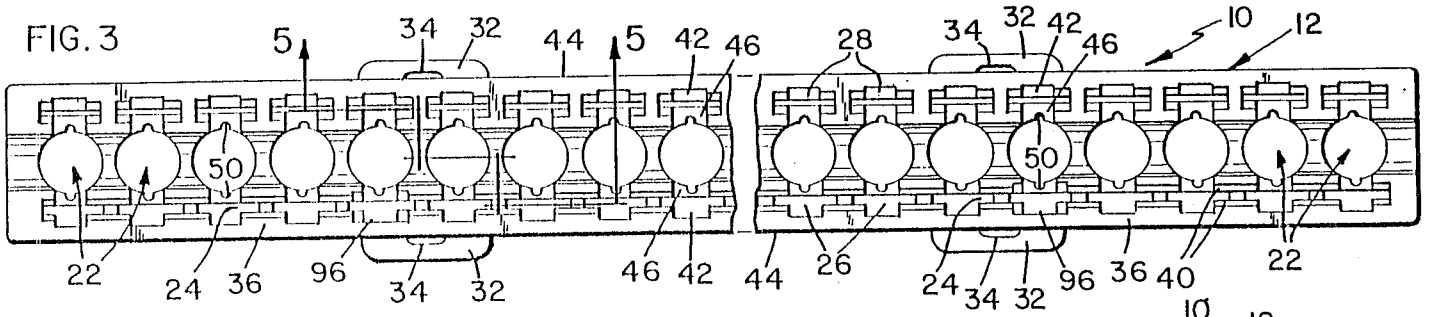
FIG. 3 is a top plan view of a housing in accordance with the present invention.
Figure 4:
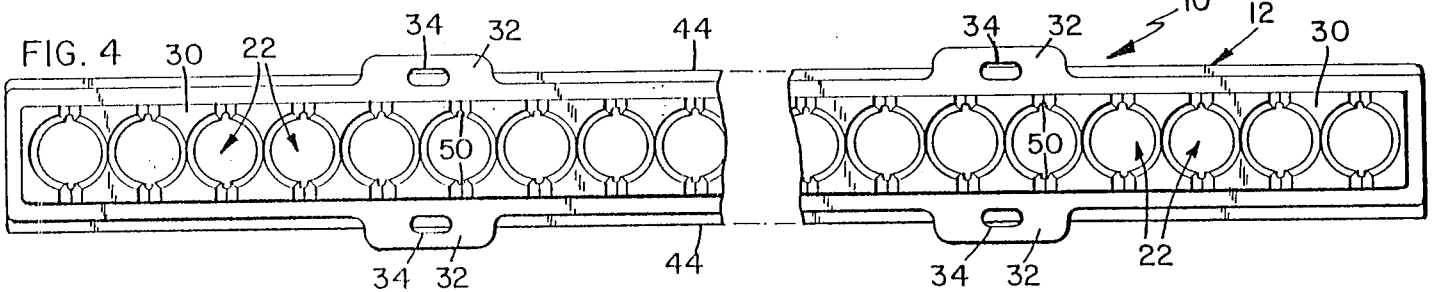
FIG. 4 is a bottom view of the housing of FIG. 3.
Figure 5:
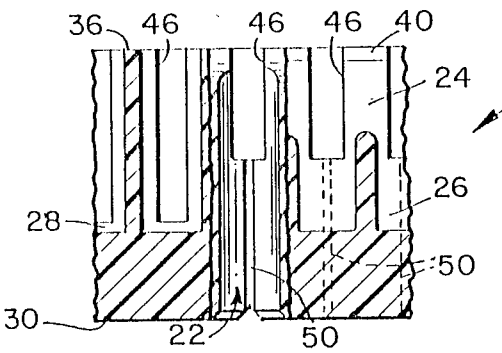
FIG. 5 is a cross-sectional view taken along 5—5 of FIG. 3.

Referring now to the drawings wherein like reference numerals designate identical or corresponding parts throughout the several views, and more particularly to FIG. 1, an apparatus for receiving lamps is designated generally by the numeral 10. Apparatus 10 includes housing 12 and the electical contacts of formed sheet 14 (see FIGS. 3 and 4). Sheet 14 includes a terminal strip 16, a plurality of contact elements 18, and a carrier 20. Housing 12 includes a row of openings or sockets 22 with a groove 24 having first pockets 26 extending therefrom on one side of the row of sockets 22 and a plurality of second pockets 28 extending in a row on the other side of the row of sockets 22. Terminal strip 16 fits in groove 24 and first pockets 26, while the plurality of contact elements 18 fit in second pockets 28.

Housing 12 is preferably an integral part molded from an electrically insulating material. Housing 12 is longitudinally elongated with the row of sockets 22 preferably centered and running along the longitudinal direction. Sockets 22 extend through housing 12. A plurality of flange members 32 extend from both sides of housing 12 near front 30. Flange members 32 include a circular or an elongated opening 34 for receiving a screw or other mechanism for attaching apparatus 10 to a frame (not shown).

Figure 2:
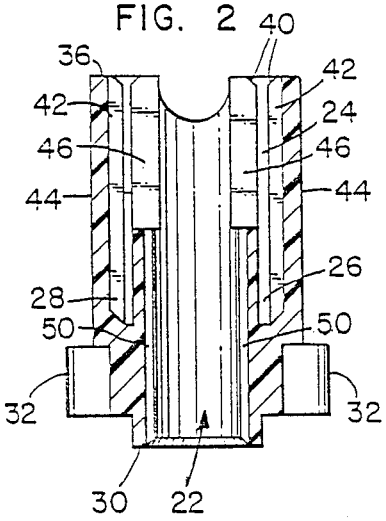
FIG. 2 shows a cross-sectional view taken generally along line 2—2 of FIG. 1.

Groove 24 is formed in the rear 36 of housing 12. Groove 24 extends about one third of the distance between front 30 and rear 36 of housing 12. Groove 24 has a width greater than the thickness of sheet 14, but less than the thickness from one side of sheet 14 to the other side of the retention tabs 82 of terminal strip 16. It is necessary for retention tabs 82 to press into a sidewall of groove 24 when terminal strip 16 is installed. Groove 24 preferably includes beveled edges 40 at rear surface 36 as shown in FIG. 2.

First pockets 26 extend from groove 24 about another third of the distance between rear 36 and front 30 toward front 30. Each first pocket 26 is centered on a transverse plane passing through a socket 22.

Second pockets 28 as indicated hereinbefore are aligned along the side of the row of sockets 22 opposite the side in which groove 24 is formed. Each second pocket 28 is also centered on a transverse plane passing through the center of a socket 22. Each second pocket 28 extends into housing 12 from rear 36 to front 30 approximately the same distance as groove 24 and first pockets 26 combined.

The inner end portions of second pockets 28 have a width only slightly greater than sheet 14. The outer end portion has a width greater than the thickness of sheet 14, but less than the thickness from one side of sheet 14 to the other side of the retention tabs 112 of contact elements 18. The second pockets 28 have sufficient length in the longitudinal direction to just receive a contact element 18. Both first and second pockets 26 and 28 include a recess 42 in the outer wall 44. Recess 42 is centered on each pocket and extends from rear 36 toward front 30 to near the bottom of each pocket. A slot 46 extends between each first and second pocket 26 and 28 and a socket 22. Slot 46 extends from rear 36 toward front 30 sufficiently far so that when each of terminal strip 16 and the plurality of contact elements 18 are fully installed that contact portions 88 extend through the slots to make contact with the contact wires or surfaces 60 on lamp 52. Slots 46 and recesses 42 have width at least as great as springs 66 and 100. Both groove 24 and second pockets 28 are beveled at rear 36.

Each socket 22 is cylindrical and extends completely through housing 12 from front 30 to rear 36. The front edge of each socket 22 is preferably beveled. Second recesses 50 are formed along opposite sides of each socket 22 centered on the transverse plane passing through the center of the socket 22.

As shown in FIG. 2, a lamp 52 has a housing 54. Housing 54 supports light emitting diode 56. LED 56 is electrically connected to a circuit board 58. Circuit board 58 is electrically connected to wire leads 60. As indicated hereinbefore, the prior art includes lamp receiving devices wherein the wire leads project directly outwardly from housing 54 to be forced into a contacting relationship with some kind of a contact element. A problem is that installation of the lamp often causes a connection between a lead wire 60 and circuit board 58 to fail. With the present invention, wire leads 60 are bent next to the end surface 62 of housing 54 and back toward LED 56 along the sidewall 64 of housing 54. Such a configuration provides strain relief for wire leads 60 and reduces the likelihood of failure. Recesses 50 are intended to receive the portions of lead wires 60 which extend along sidewall 64 of housing 54. Contact portions 88 of springs 66 and 100 extend through slots 46 to make contact with wire leads 60.

Terminal strip 16 includes a plurality of connected contact members 68, each having a first spring 66 and a first frame portion 70. First frame portion 70 is generally rectangular. First frame portion 70 has an end 72 with truncated corners 74. The end opposite end 72 merges into a rectangular terminal 76 having a smaller width than first frame portion 70. Adjacent contact members 68 are connected approximately in the region where frame portion 70 merges with terminal 76. Adjacent contact members 68 are separated between ends 72 and connecting regions 78 by a slot 80. A retaining tab 82 is formed as a result of short slots 84 adjacent to adjacent terminal 76 in connecting region 78 in line with slot 80. Tab 82 is bent in the same direction as first spring 66. First spring 66 is formed interiorly of frame portion 70 and is connected to frame portion 70 near end 72 opposite terminal 76. First spring 66 is cantilevered with its contact portion free end 88 being formed arcuately outwardly and then inwardly. The width of first spring 66 is somewhat less than the width of recess 42 and slot 46 in housing 12. The flat side 90 of terminal strip 16 faces the outer wall 44 of housing 12. Tabs 82 press against the wall of groove 24 near sockets 22. Contact portions 86 of first spring 66 project through slots 46 and into the cylindrical space of sockets 22 in order to contact one of wire leads 60. In this way, frame portions 70 fit snugly in first pockets 26, while tabs 82 hold the other end of strip 16 firmly against the outer wall 44. Recesses 42 and slots 46 cooperate to allow springs 66 to flex. When completely installed, end 72 is a leading edge for extending to the bottom of first pockets 26. The end 90 of terminal 76 is a press edge used to press strip 16 firmly into housing 12 and is approximately flush with rear 36 of housing 12. Terminal 76 may receive a connector 92 or may be wired at opening 94 and soldered in the usual fashion. Preferably, a connector 92 is used to jumper from one apparatus 10 to another. Connectors 92 fit most conveniently in an enlarged one 96 of recesses 42 formed generally near each end of housing 12.

Individual contact elements 18 include a second frame portion 98 and a second spring 100. Frame portion 98 is generally rectangular with an end 102 having truncated corners 104. The other end 106 mates with a post 108 suitable for making a wire wrap contact in the conventional fashion. Preferably, post 108 is centered with respect to frame portion 98. Also, it is preferable for a crease 110 to extend along the length of post 108 and into frame portion 98 to strengthen post 108. A second retaining tab 112 on either side of crease 110 is formed in frame portion 98 between spring 100 and end 106 to aid in frictionally retaining elements 18 in second pockets 28. Spring 100 is formed exactly the same as spring 66. When contact element 18 is installed, end 102 forms a leading edge to rest adjacent the bottom of second pocket 28. The side of contact element 18 opposite side 114 rests against the outer wall 44 of pocket 28. Tabs 112 extend away from side 114 in the same direction as spring 100 bends away from side 114. Tabs 112 press into and against the inner wall of second pocket 28. End 106 provides a pressing edge to force contact element 18 snugly into second pocket 28 and is approximately flush with groove 36 when fully installed. Recess 42 and slot 46 cooperate to allow spring 100 to properly function and contact one of wire leads 60 of lamp 52.

With respect to sheet 14 as shown in FIG. 7, end 90 of terminal 76 of strip 16 is connected to end 102 of frame portion 98 of contact element 18. The connection 116 is creased so that sheet 14 may be easily bent and broken to separate strip 16 from individual contact elements 18. Likewise, contact elements 18 are connected to carrier 20 at connection 118. Connection 118 is formed at ends 106 of contact elements 18 and at a mating edge of carrier 20. Connection 118 is creased, also, and may be easily separated from the individual contact elements 18. Carrier 20 has a solid end 120 with a plurality of legs 122 extending down to connection 118. In this fashion, elongated slots are formed between adjacent legs 122 to receive posts 108. The individual contact elements 18 are also separated by a slot 124.

In use, an apparatus 10 is preferably assembled in the fashion illustrated in FIGS. 8A–8J. FIG. 8A shows a housing 12. FIG. 8B shows the first assembly step wherein the contact strip 16 of sheet 14 is inserted into the appropriate receiving groove 24 of housing 12. The assembly is then placed on locator pins 126 which extend into a selected few sockets 22 (FIG. 8C). Sheet 14 is broken at connection 116 to separate strip 16 from sheet 14 (FIG. 8D). The plurality of individual contact elements 18 connected together by strip 20 are then inserted into appropriate receiving pockets 28 (FIGS. 8E and 8F). A breaker bar 127 is moved, as shown in FIG. 8G, to bend carrier 20 at connection 118. Presser bar 128 is then moved downwardly as shown in FIGS. 8H and 8I to bend carrier 20 at least 90 degrees with respect to contact elements 18. Presser bar 128 contacts first and second press edges represented by ends 90 and 106 of strip 16 and contact elements 18, respectively. Presser bar 128 moves against housing 12 to press strip 16 and contact elements 18 so that ends 90 and 106 are approximately flush with rear surface 36 of housing 12. As presser bar 128 is moved away, carrier 20 falls away from assembled apparatus 10 (FIG. 8J). Preferably, apparatus 10 is assembled immediately after housing 12 is formed so that retaining tabs 82 and 112 press into warm and somewhat soft dielectric material.

Figure 2A:
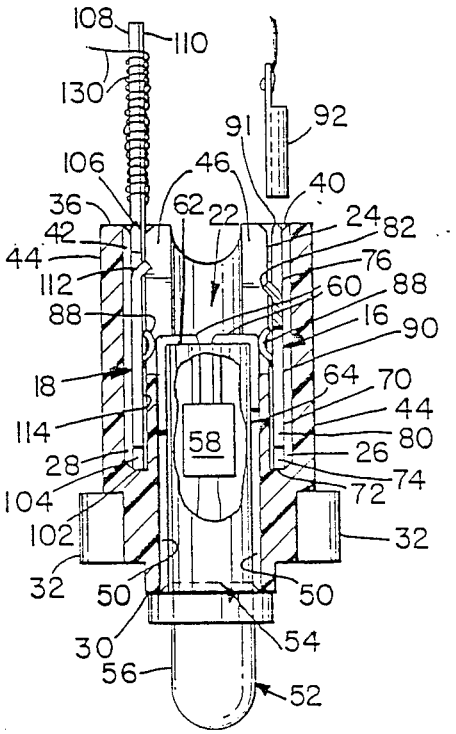
FIG. 2A is a sectional view similar to FIG. 2 but showing in addition the terminal strip, a contact element, an LED lamp and wiring in assembled relationship.

To use, housing 12 is fastened to a chassis or other frame (not shown) with screws (not shown) threaded into openings 34 of flange members 32 on housing 12. The individual contact elements 18 are wire wrapped as at 130 in FIG. 2A. The common terminal strip 16 is connected to an external ground or to another terminal strip in an adjacent apparatus 10 with a single wire having connectors 92 at the ends to fasten to terminal strip 16. Connector 92 fits into the larger one 96 of recesses 42. Lamps 52 are configured so that wire leads 60 are bent across end 62 and up sidewall 64. Wire leads 60 are then located to slide in recesses 50 on opposite sides of sockets 22. Lamp 52 is pushed into socket 22 until a flange on housing 54 of lamp 52 contacts front surface 30 of housing 12. As lamp 52 is being pushed into place, springs 66 and 100 are flexed so as to force contact portions 88 against wire leads 60. Lamps 52 are easily pulled from housing 12 for replacement.

As presented, therefore, the present invention provides not only apparatus for receiving efficiently and reliably a plurality of LED lamps in a fashion which reduces the failure rate of the lamps, but also provides a method for manufacturing such apparatus in an efficient and inexpensive way. The advantages and details of structure and function as set forth have been referenced specifically to a preferred embodiment, but are considered exemplary. It is understood, therefore, that changes made, especially in matters of shape, size and arrangement, to the full extent extended by the general meaning of the terms in which the appended claims are expressed, are within the principle of the invention.

What is claimed is:

1. A method for manufacturing a lamp socket from a housing and a formed conductive sheet, said housing including a row of sockets for receiving lamps, said sheet including a terminal strip, a row of contact members and a carrier, said housing including first means on a first side of said row of sockets for receiving said strip and second means on a second side of said row of sockets for receiving said contact members, said method comprising the steps of:

(a) inserting said terminal strip on said sheet into said first receiving means of said housing;

(b) breaking said strip from said sheet;

(c) inserting said row of contact members on said sheet into said second receiving means of said housing;

(d) breaking said carrier from said row of contact members; and (e) pressing said strip and said row of contact members into a final location with respect to said housing.

2. The method in accordance with claim 1 wherein said step (d) is preceded by the step of bending said carrier with respect to said row of contact members, said breaking step (d) occurring in conjunction with said pressing step (e).

* * * * *